US010732549B1

(12) United States Patent
Furuyama

(10) Patent No.: US 10,732,549 B1
(45) Date of Patent: Aug. 4, 2020

(54) IMAGE FORMING APPARATUS AND IMAGE FORMING METHOD

(71) Applicant: TOSHIBA TEC KABUSHIKI KAISHA, Tokyo (JP)

(72) Inventor: Noboru Furuyama, Odawara Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/353,470

(22) Filed: Mar. 14, 2019

(51) Int. Cl.
*G03G 15/20* (2006.01)
*G03G 15/00* (2006.01)

(52) U.S. Cl.
CPC ..... *G03G 15/2017* (2013.01); *G03G 15/2039* (2013.01); *G03G 15/2053* (2013.01); *G03G 15/5004* (2013.01)

(58) Field of Classification Search
CPC ..... G03G 15/2017; G03G 15/2039; G03G 15/2053
See application file for complete search history.

(56) References Cited

U.S. PATENT DOCUMENTS

2015/0110513 A1* 4/2015 Nagasaki ..... G03G 15/80 399/70
2015/0331368 A1* 11/2015 Asano ..... G03G 15/2039 399/69

* cited by examiner

*Primary Examiner* — David M. Gray
*Assistant Examiner* — Andrew V Do
(74) *Attorney, Agent, or Firm* — Kim & Stewart LLP

(57) ABSTRACT

An image forming apparatus includes a heater to generate heat with AC power for fixing a toner image to a medium and a power supply device to supply the AC power to the heater according to a pattern corresponding to one of at least two different combinations of a control cycle and a resolution in duty ratio. The control cycle corresponds to an integer multiple of a nominal AC power cycle. The duty ratio reflects a number of nominal AC power cycles in the control cycle during which the heater is in an on state.

12 Claims, 14 Drawing Sheets

IMAGE FORMING APPARATUS AND IMAGE FORMING METHOD

FIELD

Embodiments described herein relate generally to an image forming apparatus and an image forming method.

BACKGROUND

Duty ratio control is known in which AC power is supplied or stopped (hereinafter, referred to as "on" and "off", respectively) when a voltage of AC power becomes 0 V, and a value of the AC power is controlled. An image forming apparatus is also known that uses such duty ratio control to control a value of AC power supplied to a heater of a fixing device to adjust a heating temperature for fixing a toner image being transferred to paper.

A frequency of the power supplied from a power company (hereinafter, referred to as a "commercial power source") may vary depending on country or region.

A cycle of AC power and a cycle of turning on or off the AC power might not be synchronized if a duty ratio control cycle for the heater of a fixing device is not changed when the frequency of commercial power source is changed. In this case, since a waveform of the AC power supplied to the heater collapses, a harmonic component is increased. In this case, it may not be possible to control a duty ratio of power supply to the heater and a heating temperature of the heater with required resolution according to a configuration and working conditions of an image forming apparatus incorporating the fixing device.

DETAILED DESCRIPTION

Figure 1:
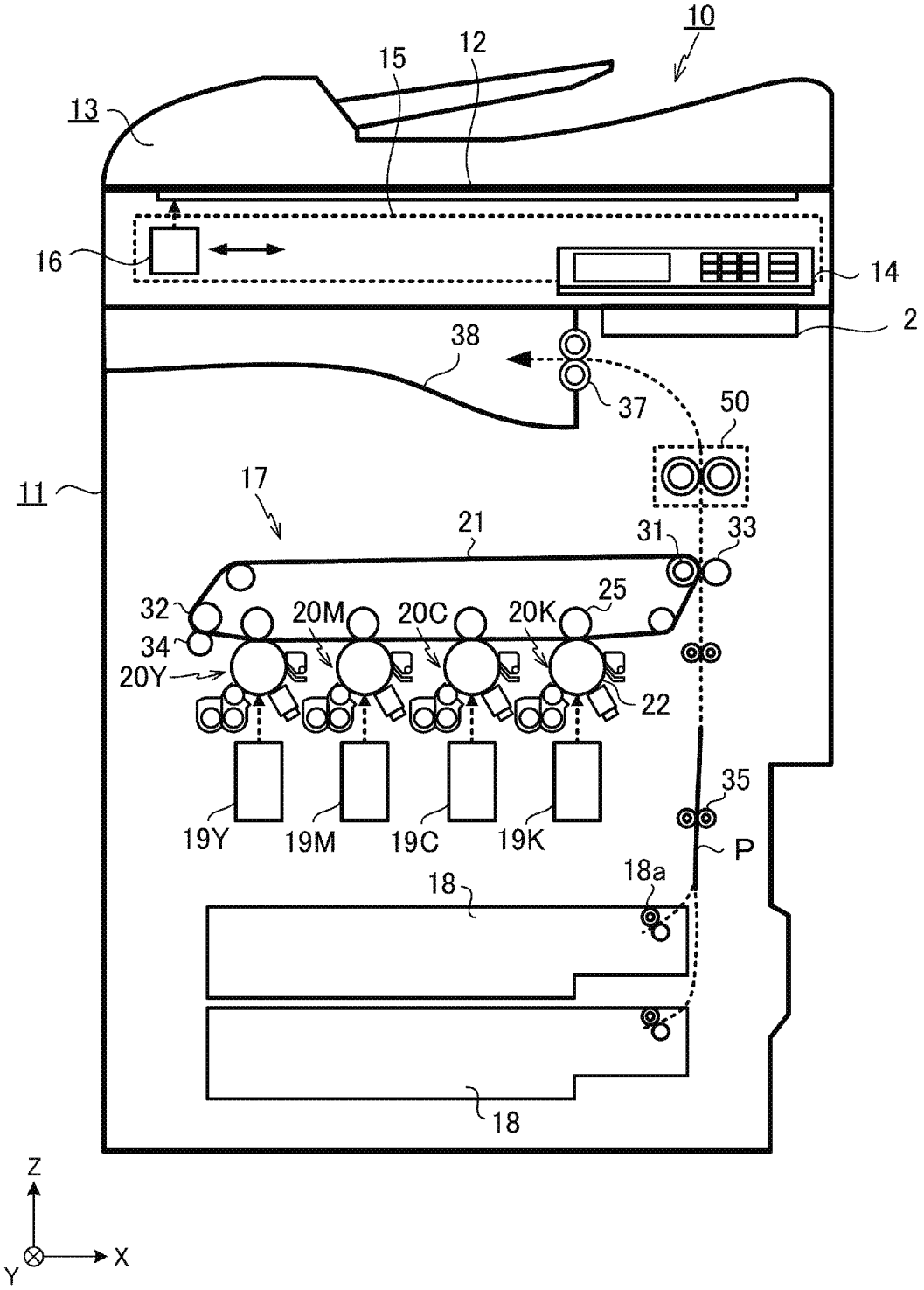
FIG. 1 depicts aspects of an image forming apparatus according to a first embodiment.

In general, according to one embodiment, an image forming apparatus comprises a heater configured to generate heat with AC power for fixing a toner image to a medium and a power supply device configured to supply the AC power to the heater according to a pattern corresponding to one of at least two different combinations of a control cycle and a resolution in duty ratio. The control cycle corresponds to an integer multiple of a nominal AC power cycle. The duty ratio reflects a number of nominal AC power cycles in the control cycle during which the heater is in an on state.

First Embodiment

An image forming apparatus according to an example embodiment is described with reference to drawings. For the purposes of explanation, an XYZ coordinate system is used and components and other aspects which depicted in different figures are denoted by the same reference numerals. Also, in description and drawings, various components, wires, and connections that are not essential to the explanation of the example embodiments may be omitted though such components, wires, and connections may be presented in an actual implementation of the examples.

FIG. 1 is a diagram schematically illustrating a configuration of an image forming apparatus 10 according to a first embodiment. The image forming apparatus 10 is, for example, a multi-function peripheral (MFP). The image forming apparatus 10 performs image formation processes or the like for printing on paper (paper P) according to a print command from a user.

The image forming apparatus includes a control device 2, a main body portion 11, and an automatic document feeder (ADF) 13 arranged above the main body portion 11. An original document table 12 formed of transparent glass is arranged on the upper portion of the main body portion 11, and the ADF 13 is provided to be able to swing open and close to cover/reveal a top surface side of the original document table 12. Also, an operation panel 14 is provided on the upper portion of the main body portion 11. The operation panel 14 includes various keys, buttons, displays images for a graphical user interface (GUI), and receives user's input via the various keys, buttons, and GUI images.

A scanner 15 for reading an original document is provided below the original document table 12. The scanner 15 generates image data by scanning original documents fed by the ADF 13 or an original document manually placed on the original document table 12. The scanner 15 includes an image sensor 16.

When reading an image of the original document placed on the original document table 12, the image sensor 16 reads the image of the original document while moving (e.g., in a +X direction) along the undersurface of the original document table 12. When reading an image of an original document supplied to the original document table 12 by the ADF 13, the image sensor 16 is kept at a fixed at the position illustrated in FIG. 1 and reads images of original documents (or pages thereof) in sequence as fed by the ADF 13.

An image forming unit 17 is within the main body portion 11. The image forming unit 17 forms an image obtained by rendering image data input from the scanner 15 or a personal computer on a recording medium, such as a sheet of paper or the like accommodated in a paper feeding cassette 18.

The image forming unit 17 includes image forming units 20Y, 20M, 20C, and 20K, which form latent images by using yellow (Y), magenta (M), cyan (C), and black (K) toner, respectively. The image forming unit also includes scanning heads 19Y, 19M, 19C, and 19K (provided in correspondence with the image forming units 20Y, 20M, 20C, and 20K) and an intermediate transfer belt 21, and the like.

The image forming units 20Y, 20M, 20C, and 20K are arranged below the intermediate transfer belt 21. In the image forming unit 17, the image forming units 20Y, 20M, 20C, and 20K are aligned from a −X side to a +X side. The scanning heads 19Y, 19M, 19C, and 19K are arranged below the respective image forming units 20Y, 20M, 20C, and 20K.

Figure 2:
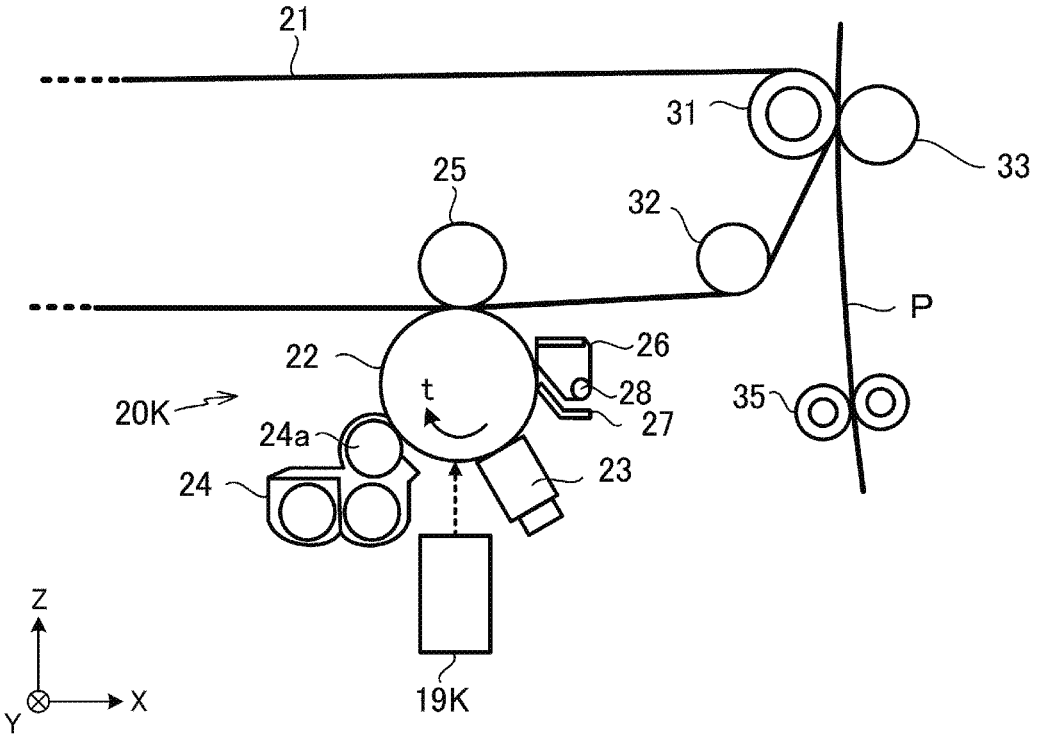
FIG. 2 depicts aspects of an image forming unit.

FIG. 2 is an enlarged diagram illustrating the image forming unit 20K from among the image forming units 20Y, 20M, 20C, and 20K. The image forming units 20Y, 20M, 20C, and 20K all have the same configuration. Accordingly, a configuration of each is provided by an example of the image forming unit 20K.

The image forming unit 20K includes a photoconductive drum 22 as an image carrier. A charging charger 23, a developing device 24, a primary transfer roller 25, a cleaner 26, a blade 27, an auger 28, and the like are arranged in a direction indicated by an arrow t around the photoconductive drum 22.

A laser beam is irradiated onto an exposed portion of the photoconductive drum 22 from the scanning head 19K. An electrostatic latent image is formed on a surface of the rotating photoconductive drum 22 by the laser beam.

The charger 23 of the image forming unit 20K uniformly charges the surface of the photoconductive drum 22. The developing device 24 supplies toner to the photoconductive drum 22 using a developing roller 24*a* to which a developing bias is applied, and forms a toner image by developing the electrostatic latent image. The cleaner 26 removes residual toner on the surface of the photoconductive drum 22 by using the blade 27. Toner scrapped off by the blade 27 is transferred along a +Y axis direction by the auger 28.

As illustrated in FIG. 1, the intermediate transfer belt 21 is wound over a driving roller 31 and three driven rollers 32. The intermediate transfer belt 21 is rotated counterclockwise in FIG. 1 as the driving roller 31 rotates. Also, as illustrated in FIG. 1, the intermediate transfer belt 21 is in contact with a top surface photoconductive drum 22 of each of the image forming units 20Y, 20M, 20C, and 20K. A primary transfer voltage is applied by the primary transfer roller 25 to a position of the intermediate transfer belt 21 facing the photoconductive drum 22. Accordingly, the toner image developed on the surface of the photoconductive drum 22 is transferred to the intermediate transfer belt 21, which is referred to as a primary transfer.

A secondary transfer roller 33 is arranged to face the driving roller 31 with the intermediate transfer belt 21 therebetween. When the paper P passes between the driving roller 31 and the secondary transfer roller 33, a secondary transfer voltage is applied to the paper P by the secondary transfer roller 33. Then, the toner image formed on the intermediate transfer belt 21 is transferred to the paper P, which is referred to as a secondary transfer. A belt cleaner 34 is provided near the driven rollers 32, as illustrated in FIG. 1. Residual toner on the surface of the intermediate transfer belt 21 is removed by the belt cleaner 34.

As illustrated in FIG. 1, a paper feeding roller 35 is provided between the paper feeding cassette 18 and the secondary transfer roller 33. The paper P discharged from the paper feeding cassette 18 by a pickup roller 18*a* arranged near the paper feeding cassette 18 is conveyed between the intermediate transfer belt 21 and the secondary transfer roller 33 by the paper feeding roller 35.

A fixing device 50 is provided above the secondary transfer roller 33. Also, a paper discharge roller 37 is provided after the fixing device 50. The paper P passing through the intermediate transfer belt 21 and the secondary transfer roller 33 is heated in the fixing device 50. Accordingly, the toner image is fixed on the paper P. The paper P passing through the fixing device 50 is discharged to a paper discharge unit 38 by the paper discharge roller 37.

Figure 3:
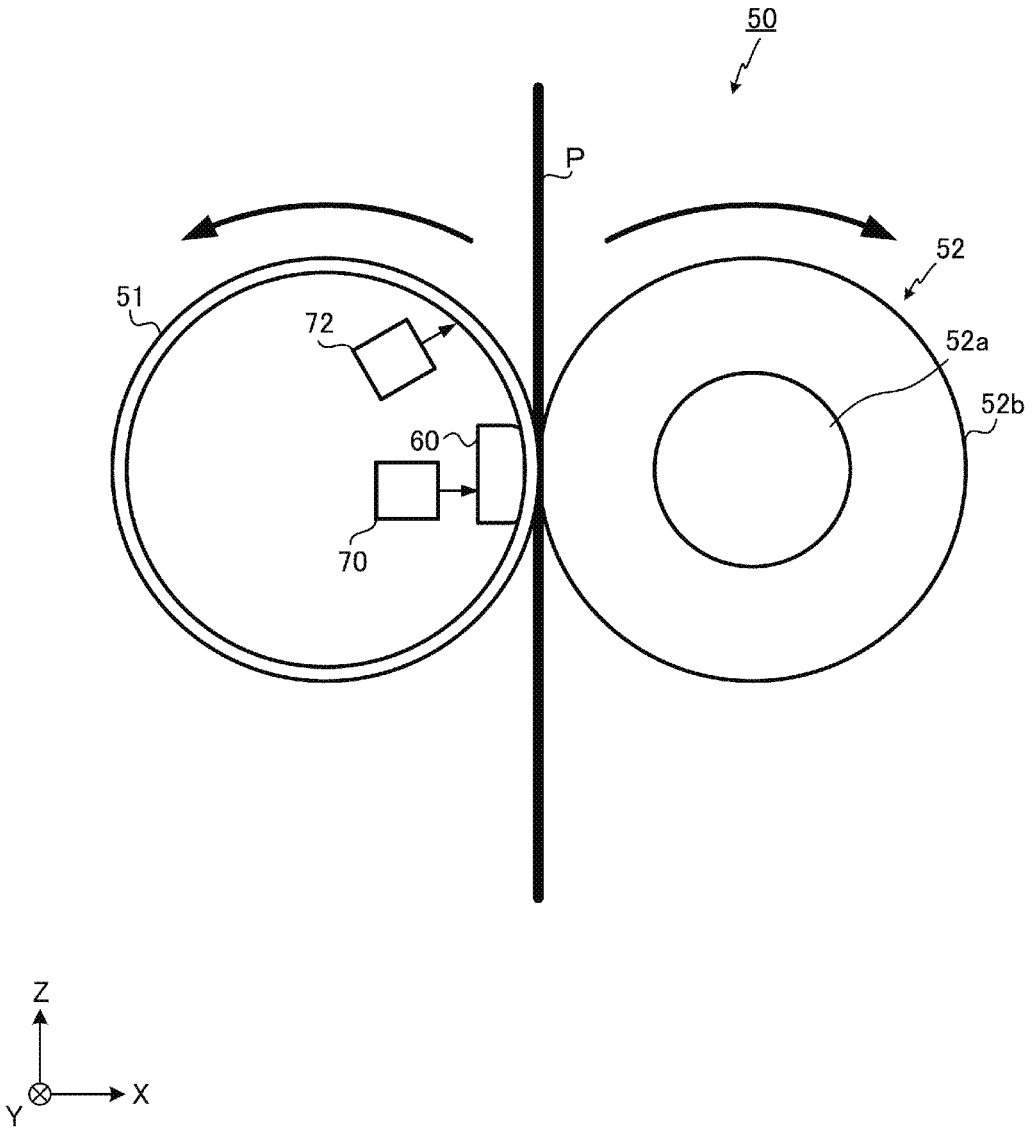
FIG. 3 depicts aspects of a first fixing device.

FIG. 3 is a diagram illustrating the fixing device 50. The fixing device 50 includes a fixing member 51, a pressing roller 52, a heater 60 disposed inside the fixing member 51, a temperature sensor 70 disposed at a position facing the heater 60 and detecting the heating temperature of the heater 60, and a temperature sensor 72 disposed near a nip portion and detecting the temperature of the fixing member 51.

Figure 4:
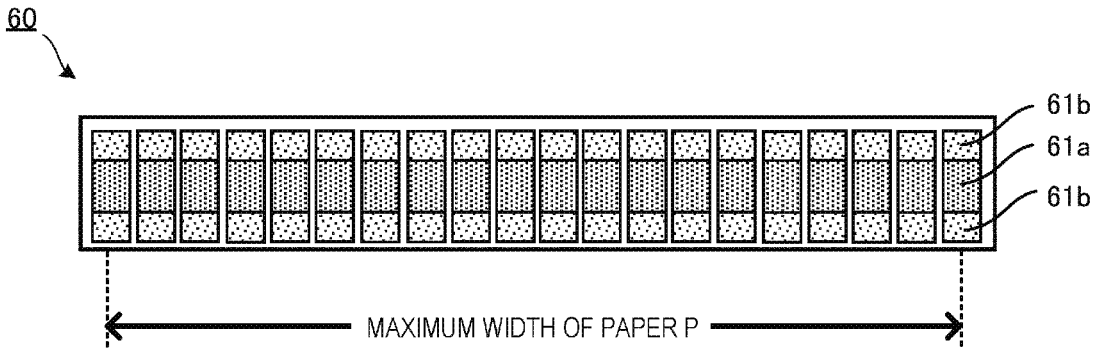
FIG. 4 depicts aspects of a heater.

FIG. 4 is a diagram illustrating a configuration of the heater 60 illustrated in FIG. 3. As illustrated in FIG. 4, the heater 60 includes a ceramic substrate, a plurality of heat generating members 61*a*, and a plurality of electrodes 61*b*. On the ceramic substrate, the plurality of heat generating members 61*a* are arranged in parallel to each other over a width greater than the width of a paper P having a maximum size in a direction (a horizontal direction in FIG. 4) perpendicular to a conveying direction of the paper P (here, "maximum size" corresponds to the maximum width of a sheet that could be printed in the image forming unit 17). The electrodes 61*b* are formed on both end portions of the heat generating members 61*a* along the conveying direction (a vertical direction in FIG. 4) of the paper P. That is, as depicted in FIG. 4, each heat generating member 61 is between two electrodes 61*b* in the vertical page direction (which is the conveying direction of the paper P). Current application to each of the heat generating members 61*a* is individually controlled by a driving IC (not illustrated) for each heat generating member. Specific examples thereof include switching elements, FETs, TRIACs, switching ICs, and the like.

The heater 60 generates heat by receiving AC power whose power value is controlled via a driving IC from a commercial power source (whose frequency may vary depending on countries or regions) and heats the fixing member 51. The temperature sensor 70 detects the temperature of the heater 60 and outputs a signal indicating the detected temperature to the control device 2. A value of the temperature of the heater 60 detected by the temperature sensor 70 is used, for example, to prevent overheating of the heater 60.

The temperature sensor 72 detects the temperature of the fixing member 51 as a temperature corresponding to a fixing temperature used to fix the toner image on the paper P, and outputs a signal indicating the detected temperature to the control device 2. The values of temperatures detected by the two temperature sensors 70 and 72 generally have a high correlation.

The fixing member 51 is a member having a cylindrical shape whose longitudinal direction is the Y axis direction. The longitudinal length (Y direction) of the fixing member is longer than a width of the paper P (the dimension in the Y axis direction for the paper P) like the heater 60 (FIG. 4). For example, the fixing member 51 comprises a film formed of stainless steel (SUS) having a thickness of 50 μm or polyimide having a thickness of 70 μm as a base material. A silicone rubber layer having a thickness of 200 μm is formed on a surface of the base material. The silicone rubber layer is itself coated with a surface protective layer formed of a perfluoro-alkoxy (PFA) coating or the like. The fixing member 51 is supported to rotate around an axis parallel to the Y axis.

The pressing roller 52 is a columnar member whose longitudinal direction is the Y axis direction. The pressing roller 52 includes a core material 52*a* formed of a metal such as aluminum, and a silicone rubber layer 52*b* laminated on an outer circumferential surface of the core material 52*a*. A surface of the silicone rubber layer 52*b* is coated with a perfluoro-alkoxy resin (PFA resin). The pressing roller 52 has an outer diameter of about 25 mm and a length substantially equal to the length of the fixing member 51. The pressing roller 52 is pressed by an elastic member toward the fixing member 51 (−X direction). As a result, the pressing roller 52 is pressed against the heater 60 via the fixing member 51. Accordingly, the surface of the pressing roller 52 and the surface of the fixing member 51 are brought into close contact with each other, and a nip through which the paper P passes from the bottom to the top (+Z direction on page) is formed.

In the nip portion, the fixing member 51 is heated by the heater 60 so as to have a temperature suitable for fixing the toner image on the paper P. The fixing member 51 is pressed against the pressing roller 52 and rotates in a counterclockwise direction while the pressing roller 52 rotates in a clockwise direction. The toner image transferred onto the paper P is heated by the heater 60 via the fixing member 51 at the nip portion and is fixed on the paper P.

Figure 5:
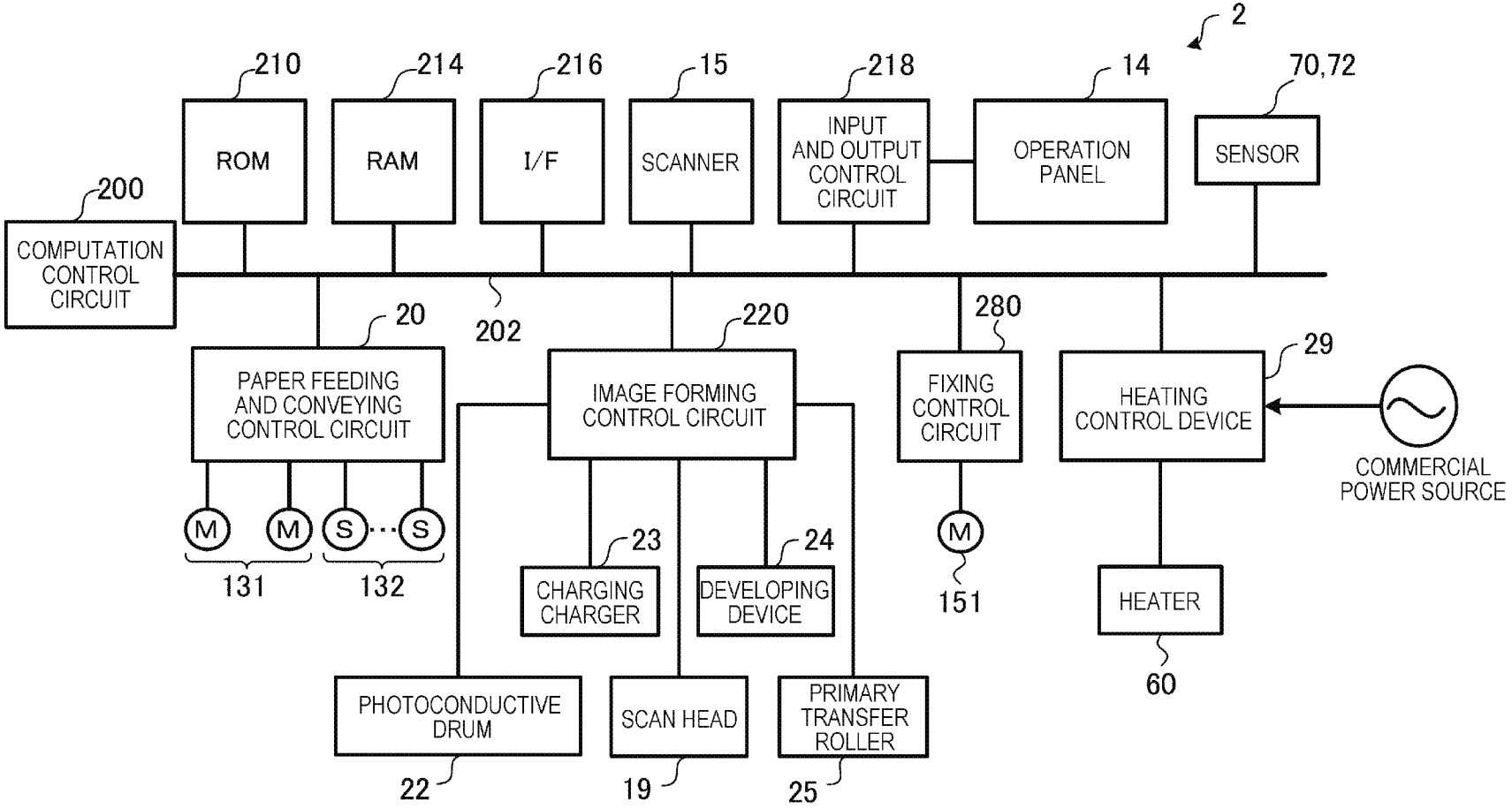
FIG. 5 schematically depicts a control system of an image forming apparatus.

FIG. 5 is a block diagram of a control system of the image forming apparatus 10. The control system includes the control device 2, and the control device 2 controls the entire image forming apparatus. As illustrated in FIG. 5, the control device 2 comprises a computation control circuit 200 including peripheral circuits, such as a CPU and a timer circuit, a bus line 202, a read only memory (ROM) 210, a random access memory (RAM) 214, an interface 216, and an input and output control circuit 218. The components of the control device 2 are connected via the bus line 202. The control system further includes a paper feeding and conveying control circuit 20, an image forming control circuit 220, a fixing control circuit 280, and a heating control device 29.

The ROM 210 stores control programs, control data, and the like for controlling an image forming operation, such as power supply to the heater 60 or the like.

The RAM 214 functions as a working memory serving as a working area of the computation control circuit 200.

The computation control circuit 200 executes a program stored in the ROM 210. Then, the control device 2 comprehensively controls each component of the image forming apparatus 10 and sequentially executes processes for forming an image on the paper P.

The interface 216 communicates with a terminal device used by a user (e.g., a personal computer) via a network. The input and output control circuit 218 displays necessary information on the operation panel 14 and receives an input from the operation panel 14. The user of the image forming apparatus 100 can, for example, specify the size of paper P, the number of copies of an original document, and the like, by operating the operation panel 14.

The paper feeding and conveying control circuit 20 controls a motor group 131 that drives the pickup roller 18*a*, the paper feeding roller 35, the paper discharge roller 37 of a conveying path, or the like based on a control signal from the control device 2. Based on the control signal from the computation control circuit 200, the paper feeding and conveying control circuit 20 controls the motor group 131 in accordance with detection results of the various sensors 132 provided near the paper feeding cassette 18, on the conveying path, or the like.

The image forming control circuit 220 controls each of the photoconductive drum 22, the charging charger 23, the scanning heads 19Y, 19M, 19C, and 19K, the developing device 24, and the primary transfer roller 25 based on a control signal from the control device 2.

The fixing control circuit 280 controls a driving motor 151 that rotates the pressing roller 52 of the fixing device 50 based on a control signal from the control device 2.

The image forming apparatus 10 forms an image when, for example, image data received through the interface 216 is to be printed or image data generated by the scanner 15 is to be printed.

Figure 6:
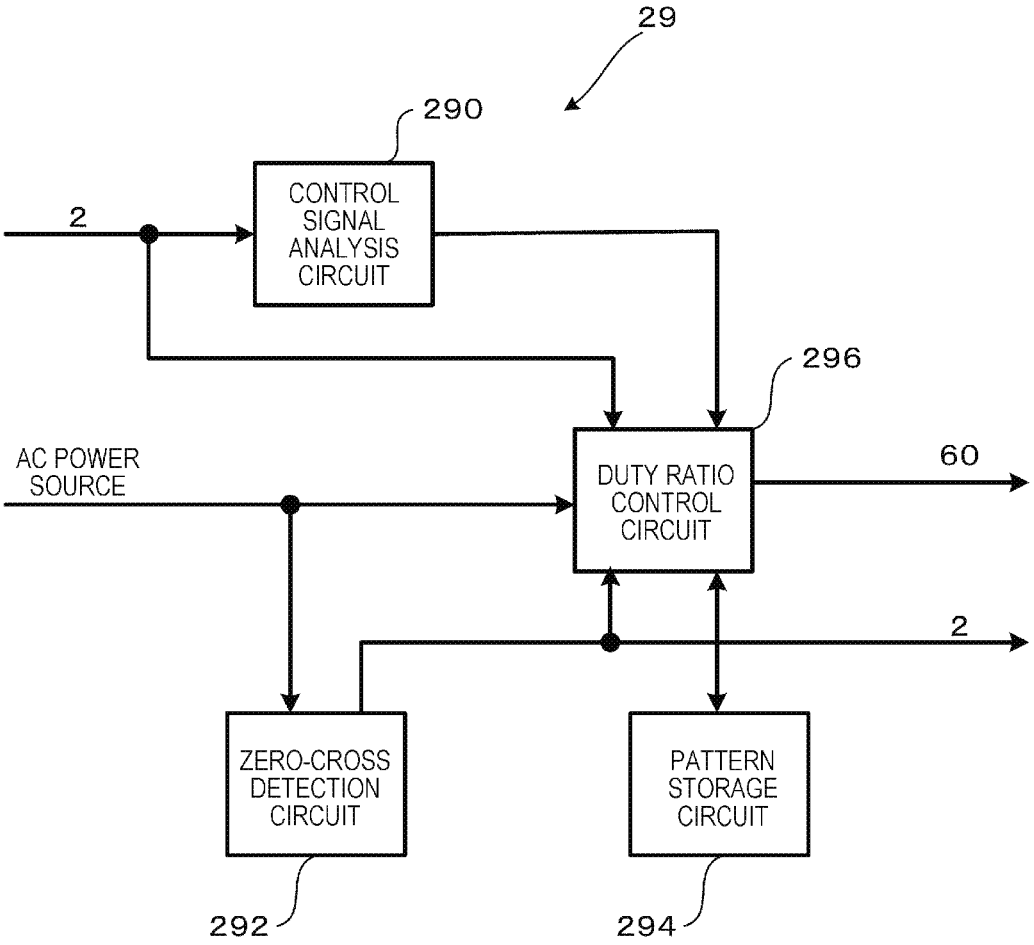
FIG. 6 depicts aspects of a heating control device.

FIG. 6 is a diagram illustrating a configuration of the heating control device 29 (illustrated in FIG. 5). As illustrated in FIG. 6, the heating control device 29 includes a control signal analysis circuit 290, a zero-crossing detection circuit 292, a pattern storage circuit 294, and a duty ratio control circuit 296. The heating control device 29 controls a power value by controlling a duty ratio of AC power supplied from a commercial power source to the heater 60 according to a control signal from the control device 2, and adjusts the heating temperature.

The control signal analysis circuit 290 analyzes a control signal input from the control device 2 (see FIG. 5), and outputs information indicating a duty ratio (corresponding to the control signal) to the duty ratio control circuit 296.

Figure 7:
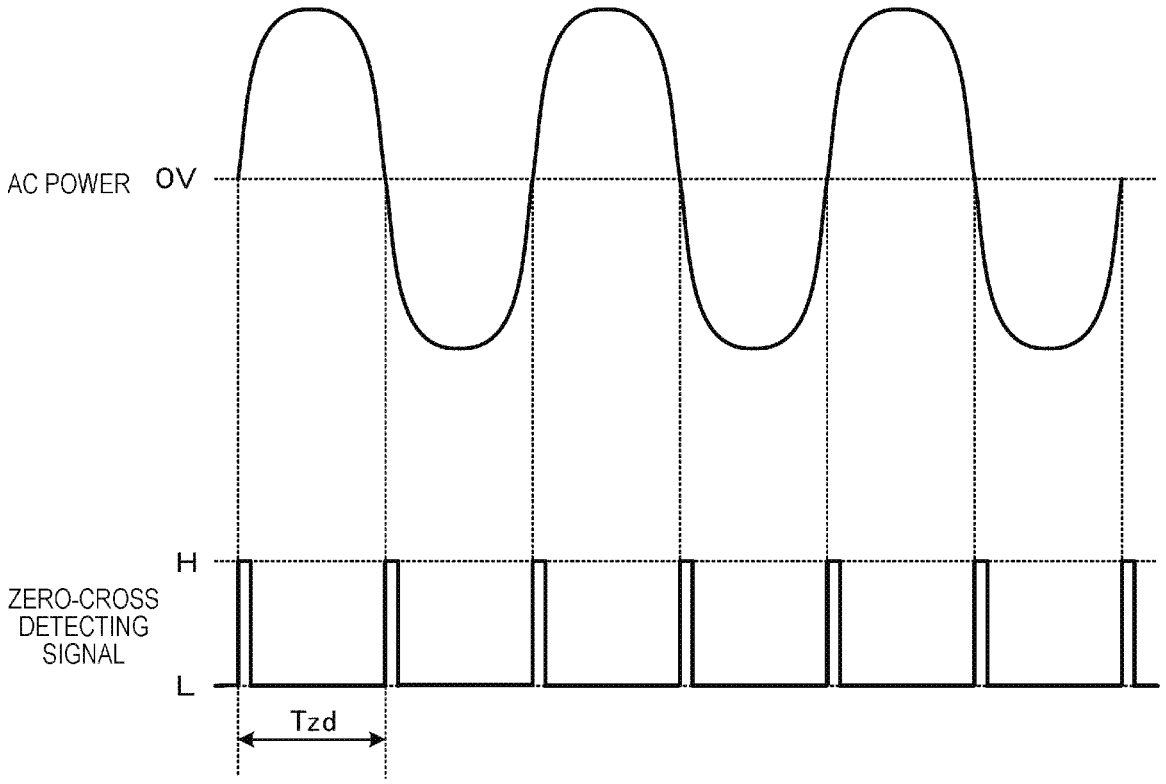
FIG. 7 illustrates aspects of an operation of a zero-crossing detection circuit.

FIG. 7 is a diagram illustrating an operation of the zero-crossing detection circuit 292. As illustrated in FIG. 7, the zero-crossing detection circuit 292 detects a time (zero-crossing point) at which a voltage of the commercial power source becomes 0 V and outputs a zero-crossing detection signal indicating the detection by output of a logical value of H or L to the duty ratio control circuit 296 and the control device 2. In the zero-crossing detection signal, the logical value is changed from L to H every half cycle of power from the commercial power source and is returned to L after a period of time pre-set by a manufacturer of the image forming apparatus 10.

A time interval Tzd for the timing at which the logical value of the zero-crossing detection signal changes from L to H is ½ of a cycle of the commercial power source, and is this time interval Tzd is used to obtain a control cycle for adjusting the temperature of the fixing member 51, that is, the heating temperature of the heater 60 (FIGS. 3 and 4). The zero-crossing detection circuit 292 can obtain the frequency of the commercial power source based on the time interval Tzd and use this frequency to adjust the heating of the heater 60.

The frequency of the commercial power source is obtained by as the inverse value of twice the time interval Tzd (frequency of commercial power source=1/(2×Tzd)). As described above, twice the time interval Tzd is equal to one cycle of the commercial power source (2×Tzd=cycle of commercial power source). In other words, obtaining the time interval Tzd is substantially equivalent to obtaining the cycle and frequency of the commercial power source since only simple arithmetic operations on the time interval value (Tzd) are required to obtain the commercial power source values.

The heating control device 29 includes a driving IC connected to each of the heat generating members 61*a* and the electrodes 61*b* (FIGS. 3 and 4) which operates based on the zero-crossing detection signal. The heating control device 29 turns power from the commercial power source on and off to each of the heat generating members 61*a* (via electrodes 61*b*) every half cycle when heating the heater 60, and controls the temperature of the fixing member 51 by adjusting the heating temperature for the heater 60. As a result, the heating control device 29 prevents the generation of harmonic components in the commercial power source and reduces electro-magnetic interference (EMI) in and around the commercial power source from the image forming apparatus 10.

In addition, the heating control device 29 can selectively supply power only to those particular heating generating member 61*a* corresponding to the width of the conveyed paper P. That is, the heating control device 29 can control subsets of the plurality of heat generating members 61*a* to heat or not. According to such an operation of the heating control device 29, supply of unnecessary power to those heat generating members 61 that are not included within the width of the conveyed paper P can be prevented.

Tables 1 and 2 below illustrate particular power supply patterns for controlling a duty ratio. The values of Tables 1 and 2 can be stored in the pattern storage circuit 294. Table 1 illustrates a supply pattern controlling power from the commercial power source at a resolution of 10% for every 5 cycles. Table 2 illustrates a supply pattern controlling power from the commercial power source at a resolution of 5% for every 10 cycles. The supply patterns illustrated by Table 1 and Table 2 are pre-determined by a supplier and stored in the pattern storage circuit 294. The stored supply patterns are read by the duty ratio control circuit 296 and used to control power supplied to the heater 60.

The duty ratio control circuit 296 turns on or off power from the commercial power source for every half cycle of the commercial power source according to an order of logical values for duty ratio control corresponding to one row of the read supply pattern. The duty ratio control circuit 296 changes a duty ratio of power from the commercial power source, thereby controlling the value of power to supply the power to the heater 60, and to adjust the heating temperature thereof.

TABLE 1

| Duty | 0 | 2 | 3 | 4 | 5 | 6 | 7 | 8 | 9 | 10 |
|---|---|---|---|---|---|---|---|---|---|---|
| 0% | L | L | L | L | L | L | L | L | L | L |
| 10% | L | L | L | L | H | L | L | L | L | L |
| 20% | L | L | H | L | L | L | L | H | L | L |
| 30% | H | L | L | H | L | L | L | H | L | L |
| 40% | L | H | L | L | H | L | H | L | L | H |
| 50% | L | H | L | H | L | H | L | H | L | H |
| 60% | H | H | L | H | L | H | L | H | H | L |
| 70% | L | H | H | L | H | H | H | L | H | H |
| 80% | H | H | L | H | H | H | H | L | H | H |
| 90% | H | H | H | H | H | H | L | H | H | H |
| 100% | H | H | H | H | H | H | H | H | H | H |

TABLE 2

| Duty | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 0% | L | L | L | L | L | L | L | L | L | L | L | L | L | L | L | L | L | L | L | L |
| 5% | L | L | L | L | L | L | L | L | L | H | L | L | L | L | L | L | L | L | L | L |
| 10% | L | L | L | L | L | L | H | L | L | L | L | L | L | H | L | L | L | L | L | L |
| 15% | L | L | L | L | H | L | L | L | L | H | L | L | L | L | L | H | L | L | L | L |
| 20% | L | L | H | L | L | L | L | H | L | L | L | L | H | L | L | L | L | H | L | L |
| 25% | L | H | L | L | L | H | L | L | L | H | L | L | L | H | L | L | L | L | H | L |
| 30% | H | L | L | H | L | L | L | H | L | L | L | H | L | L | L | H | L | L | L | H |
| 35% | L | H | L | L | H | L | L | H | L | L | H | L | L | H | L | L | H | L | L | H |
| 40% | L | H | L | L | H | L | H | L | L | H | L | L | H | L | H | L | L | H | L | H |
| 45% | L | L | H | L | H | L | H | L | H | L | H | L | H | L | H | L | H | L | H | L |
| 50% | L | H | L | H | L | H | L | H | L | H | L | H | L | H | L | H | L | H | L | H |
| 55% | H | H | L | H | L | H | L | H | L | H | L | H | L | H | L | H | L | H | L | H |
| 60% | H | H | L | H | L | H | L | H | H | H | L | H | L | H | L | H | L | H | L | H |
| 65% | H | L | H | H | L | H | H | L | H | H | L | H | H | L | H | H | L | H | H | L |
| 70% | L | H | H | L | H | H | H | L | H | H | H | L | H | H | H | L | H | H | H | L |
| 75% | H | L | H | H | H | L | H | H | H | L | H | H | H | L | H | H | H | H | L | H |
| 80% | H | H | L | H | H | H | H | L | H | H | H | H | L | H | H | H | H | L | H | H |
| 85% | H | H | H | H | L | H | H | H | H | L | H | H | H | H | H | L | H | H | H | H |
| 90% | H | H | H | H | H | H | L | H | H | H | H | H | H | L | H | H | H | H | H | H |
| 95% | H | H | H | H | H | H | H | H | H | L | H | H | H | H | H | H | H | H | H | H |
| 100% | H | H | H | H | H | H | H | H | H | H | H | H | H | H | H | H | H | H | H | H |

Column values (1 through 10) in Table 1 or column values (1 through 20) in Table 2 indicate an order of half cycles of the commercial power source in the control cycle of the commercial power source. For example, Table 1 corresponds to 5 full cycles (5×Tzd) and Table 2 corresponds to 10 full cycles (10×Tzd). Furthermore, after the last column value, the control returns to the first table column (column value "1") and repeats. In Tables 1 and 2, each logical value H indicates that power supply to the heater 60 is turned on for the respective half cycle (corresponding to the particular column value) in each control cycle (e.g., Table 1 is for a control cycle that repeats after 10 half cycles; Table 2 is for a control cycle that repeats after 20 half cycles).

The heating control device 29 performs duty ratio control according to a control signal from the control device 2. In other words, in the heating control device 29, when a difference between a setting value for the temperature of the fixing member 51 and the temperature of the fixing member 51 that is detected by the temperature sensor 72 is smaller than some value pre-set by the manufacturer, a supply pattern of Table 2, in which a resolution of a duty ratio is high, is selected. When the difference is equal to or larger than the pre-set value, a supply pattern of Table 1, in which a resolution of a duty ratio is lower than that of the supply pattern illustrated in Table 2, is selected.

Figure 8:
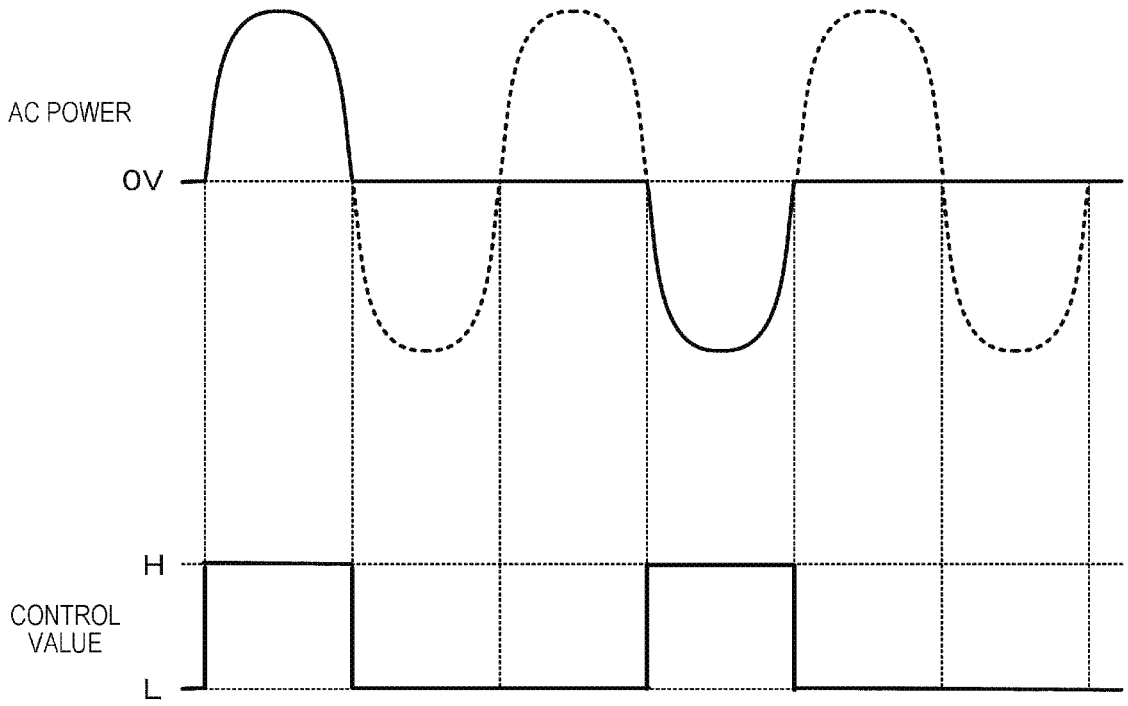
FIG. 8 illustrates aspects of duty ratio control by a duty control circuit.

FIG. 8 is a diagram illustrating duty ratio control by the duty ratio control circuit 296. Here, logical values H and L of FIG. 8 correspond to the logical values H and L of Tables 1 and 2.

Based on a result of analyzing a control signal by the control signal analysis circuit 290, the duty ratio control circuit 296 reads the supply pattern illustrated in Table 1 or Table 2 from the pattern storage circuit 294 when duty ratio control of power supplied to the heater 60 is performed. As illustrated in FIG. 8, the duty ratio control circuit 296 performs turning on or off of AC power to the heater 60 from the commercial power source every half cycle according to the read supply pattern.

Hereinafter, an operation of image formation in the image forming apparatus 10 is described. When the image formation is performed, as illustrated in FIG. 1, the paper P is pulled out from the paper feeding cassette 18 by the pickup roller 18*a*, and conveyed between the intermediate transfer belt 21 and the secondary transfer roller 33 by the paper feeding roller 35.

In parallel with such an operation, the image forming units 20Y, 20M, 20C, and 20K each forms a toner image on the photoconductive drum 22. The toner images formed on the photoconductive drums 22 by each of the image forming units 20Y, 20M, 20C, and 20K are sequentially transferred to the intermediate transfer belt 21. Accordingly, a toner image including yellow (Y), magenta (M), cyan (C), and black (K) toner is formed on the intermediate transfer belt 21.

The toner image formed on the intermediate transfer belt 21 is transferred to the paper P when the paper P conveyed between the intermediate transfer belt 21 and the secondary transfer roller 33 passes through the intermediate transfer belt 21 and the secondary transfer roller 33. Then, the toner image including yellow (Y), magenta (M), cyan (C), and black (K) toner is formed on the paper P.

The paper P on which the toner image has been formed passes through the fixing device 50. At this time, the heating control device 29 controls the power supply from the commercial power source to the heater 60 such that the temperature detected by the temperature sensor 72 approaches the setting value of the temperature of the fixing member 51. As a result, the heating temperature of the heater 60 is adjusted, the paper P is heated at a temperature suitable for fixing the toner image in the fixing device 5, the toner image is fixed on the paper P, and an image is thus printed on the paper P.

Hereinafter, a control program 3 controlling an operation of the image forming apparatus 10 is described. A command code for the control program 3 described below is stored in the ROM 210 by the manufacturer and is provided to the control device 2 (FIGS. 1 and 5) of the image forming apparatus 10. The control program 3 is executed by the computation control circuit 200 using an operating system (OS), such as Android or Industrial TRON (The Real-time Operating System Nucleus; ITRON).

Figure 9:
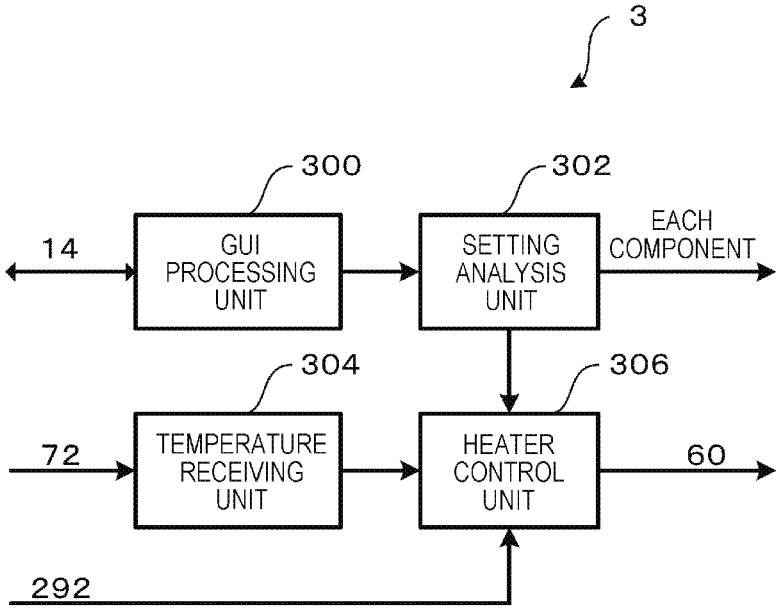
FIG. 9 depicts aspects of a control program.

FIG. 9 is a diagram illustrating a configuration of the control program 3. The control program 3 controls each component of the image forming apparatus 10 according to an operation of the user on the operation panel 14 (FIG. 1), and performs the image formation and also other operations such as facsimile transmission, and the like. As illustrated in FIG. 9, the control program 3 includes a GUI processing unit 300, a setting analysis unit 302, a temperature receiving unit 304, and a heater control unit 306.

The GUI processing unit 300 displays a GUI image on the operation panel 14 for the user and receives information indicating an operation from the displayed GUI image or the like as a setting by the user from the control device 2 with respect to the image forming apparatus 10. The GUI processing unit 300 outputs a setting received from the user to the setting analysis unit 302.

The setting analysis unit 302 analyzes contents of the setting to determine the number of printing sheets, and the size and type of the paper P as set by the user to form an image, or determine whether another operation is to be performed. Furthermore, when the user instructs the image forming apparatus 10 to form an image, the setting analysis unit 302 obtains a setting value of the temperature of the fixing member 51 (FIG. 3), which matches the number of sheets to be printed, the size of the paper, and the type of the paper.

For example, the setting value of the temperature of the fixing member 51 can be obtained via experiments or simulation performed by the manufacturer for each combination of the number of sheets, size, and type, and is given to the setting analysis unit 302 as a table or the like. In this case, the setting analysis unit 302 obtains the setting value of the temperature of the fixing member 51 corresponding to the requested combination of the number of sheets, size, and type from the given table.

The temperature receiving unit 304 receives a value of the temperature of the fixing member 51 detected by the temperature sensor 72 (FIGS. 3 and 5), and outputs the value to the heater control unit 306.

As a result of analysis by the setting analysis unit 302, the heater control unit 306 processes the value of the temperature of the fixing member 51 received by the temperature receiving unit 304 and a zero-crossing detection signal input from the zero-crossing detection circuit 292. Based on the result of the process, the heater control unit 306 further adjusts the heating temperature of the heater 60 to the heating control device 29 (FIGS. 5 and 6) and so the fixing member 51 is a suitable temperature to fix the toner image on the paper P.

Figure 10:
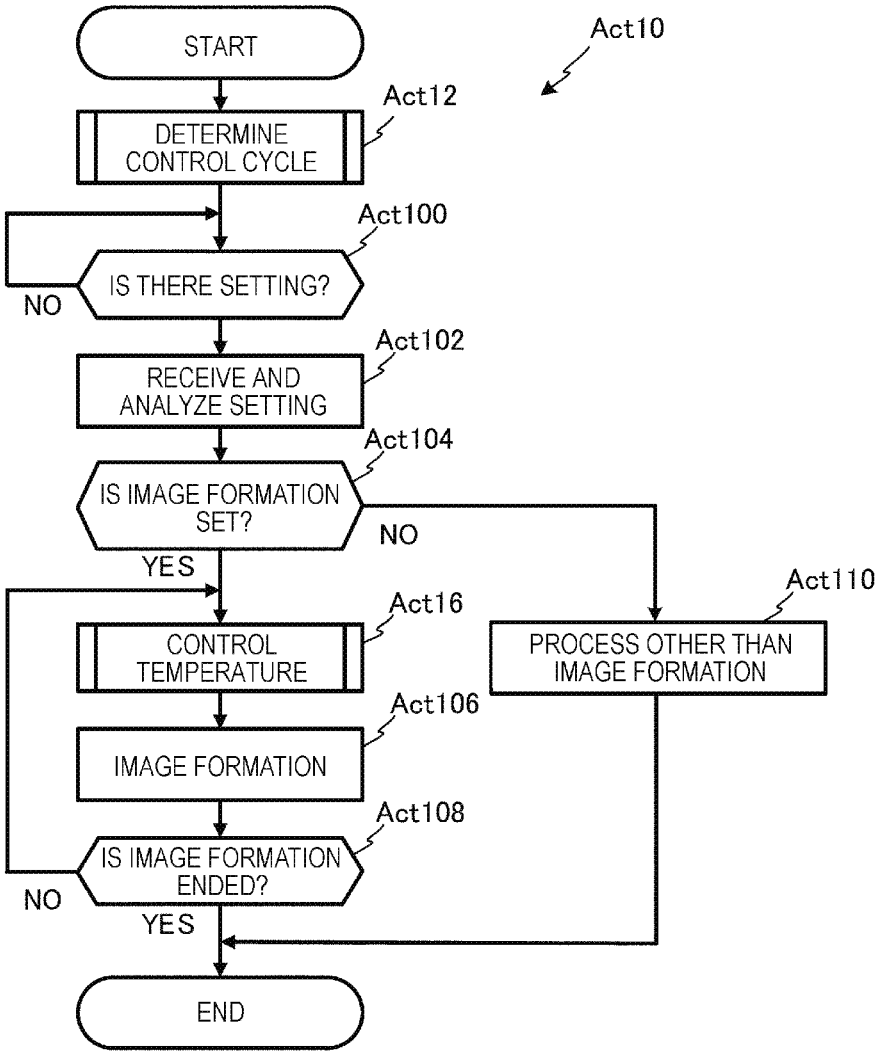
FIG. 10 is a flowchart of aspects of an overall process of a control program.
Figure 11:
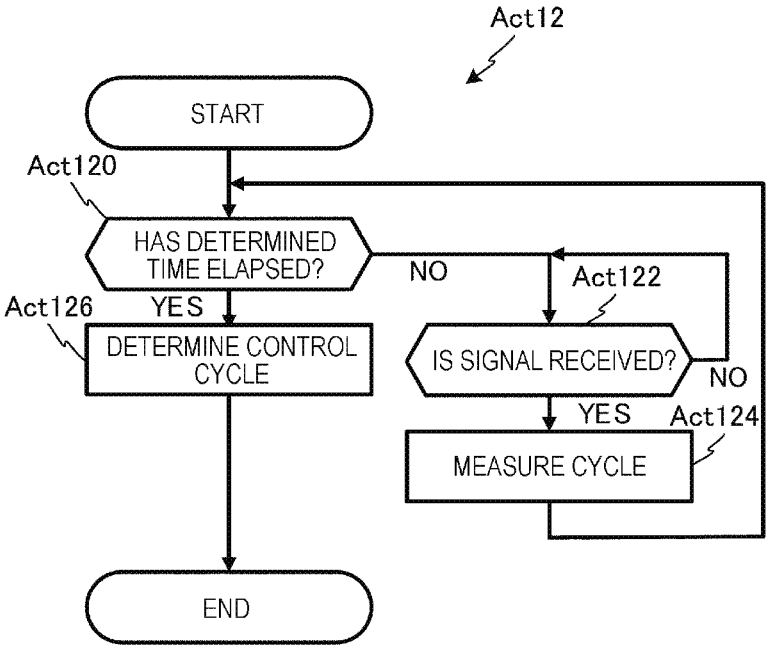
FIG. 11 is a flowchart of aspects of a control cycle calculation process of a control program.

Hereinafter, processes of the control program 3 are described with reference to a flowchart. FIG. 10 is a flowchart illustrating an overall process (ACT 10) of the control program 3. FIG. 11 is a flowchart illustrating a control cycle calculation process (ACT 12) of the control program 3. As illustrated in FIG. 10, processes of ACT 10 by the control program 3 are started. Processes of ACT 12 are performed after execution of the control program 3 has been started and before the power supply to the heater 60 is begun.

In ACT 12, as illustrated in FIGS. 10 and 11, the heater control unit 306 (FIG. 9) of the control program 3 processes the zero-crossing detection signal (FIG. 7) input from the zero-crossing detection circuit 292 (FIG. 6), and calculates the time interval Tzd by using a clock signal of a CPU included in the computation control circuit 200. Furthermore, the heater control unit 306 multiplies the obtained time interval Tzd by ten (10) (when the resolution is 10%) or by twenty (20) (when the resolution is 5%) according to the necessary resolution to calculate a control cycle corresponding to the column values 1 to 10 and column values 1 to 20 of Tables 1 and 2, respectively.

When the frequency of the commercial power source is 50 Hz, the time interval Tzd is 10 ms ($10=1000/(2\times50)$), and thus the control cycle at this time is 100 ms or 200 ms. Alternatively, when the frequency of the commercial power source is 60 Hz, the time interval Tzd is about 8.3 ms ($8.3\approx1000/(2\times60)$), and thus the control cycle at this time is about 83.3 ms or about 166.7 ms. When the control cycle is not an integer multiple of a cycle of a clock signal of the CPU included in the computation control circuit 200 of the control device 2 (FIGS. 1 and 5), a deviation occurs between the control cycle and a cycle of the commercial power source (=1/frequency of commercial power source) and, after a relatively long period of time, an error occurs in the duty ratio control. In order to eliminate such a deviation, the control cycle is corrected by the heater control unit 306 at an appropriate time interval so as to be synchronized to a timing at which the logical value of the zero-crossing detection signal changes from L to H.

In ACT 100 (FIG. 10), the GUI processing unit 300 (FIG. 9) determines whether the operation panel 14 of the image forming apparatus 10 is set by the user for image formation or another operation. When there is a setting (Yes in a process of ACT 100), the control program 3 proceeds to a process of ACT 102, and otherwise (NO in the process of ACT 100), the control program 3 remains in the process of ACT 100.

In ACT 102, the GUI processing unit 300 receives the contents of the setting from the user on the operation panel 14 and outputs the setting to the setting analysis unit 302. The setting analysis unit 302 analyzes the contents of the setting input from the GUI processing unit 300 and obtains the set operation mode of the image forming apparatus 10, the number of sheets of the paper P, and the like.

In ACT 104, the setting analysis unit 302 determines whether the setting for image formation has been performed in the image forming apparatus 10 in the process of ACT 100. In the control program 3, when the setting for the image formation has been performed in the image forming apparatus 10, the setting analysis unit 302 obtains the setting value for the temperature of the fixing member 51, that is, the setting value for the heating temperature of the heater 60 (FIGS. 3 and 4) to proceed to a process of ACT 16, and otherwise, proceeds to a process of ACT 110.

Figure 12:
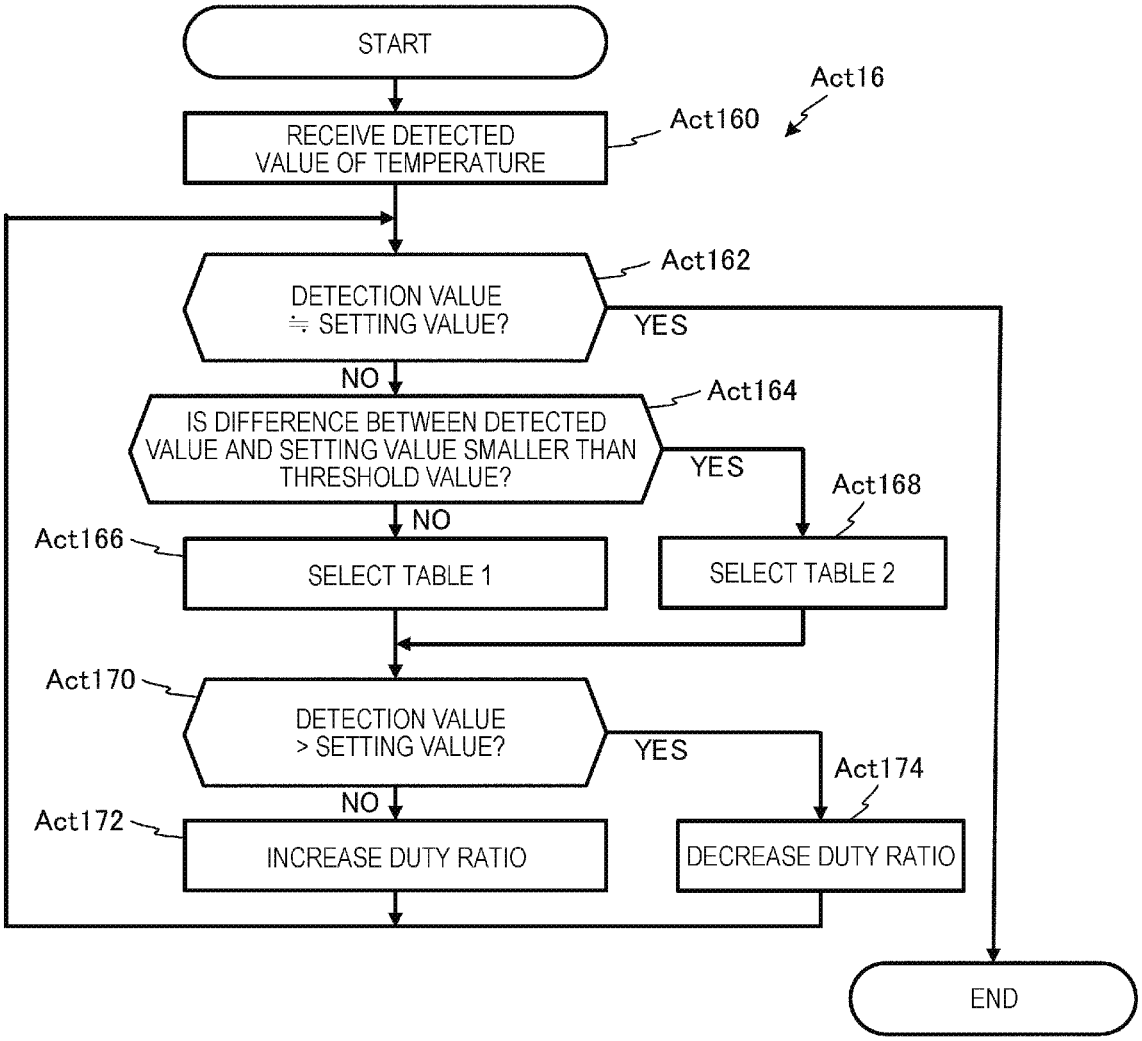
FIG. 12 is a flowchart of aspects of a first temperature control process of a control program.

FIG. 12 is a flowchart illustrating a first temperature control process (ACT 16) of the control program 3 illustrated in FIG. 10. As illustrated in FIGS. 10 and 12, in ACT 16, the control program 3 outputs a control signal from the control device 2 to the heating control device 29, the control signal enabling a difference between the value of the heating temperature of the fixing member 51, that is, the heater 60, obtained from the temperature sensor 72 (FIGS. 3 and 5) and the setting value of the heating temperature of the heater 60 obtained in the process of ACT 104 to be within an error range. The heating control device 29 supplies power to the heater 60 according to a control signal from the control device 2 and further adjusts the heating temperature of the heater 60 by changing the duty ratio of power supplied to the heater 60.

In ACT 106 (FIG. 10), the setting analysis unit 302 (FIG. 9) outputs a control signal to each component of the image forming apparatus 10 according to the result of analyzing the contents of setting performed in ACT 102, and performs the operation of image formation.

In ACT 108, the setting analysis unit 302 determines whether the image formation has ended. When the image formation is ended (YES in the process of ACT 108), the control program 3 ends the process, and otherwise (NO in the process of ACT 108), returns to the process of ACT 16.

In ACT 110, the control program 3 outputs a control signal to each component of the image forming apparatus 10 to cause the image forming apparatus 10 to perform an operation other than image formation, such as facsimile transmission.

The process of ACT 12 illustrated in FIG. 10 is described in more detail with reference to FIG. 11. The process of ACT 12 is executed when the execution of the control program 3 (FIG. 9) is started, that is, when a power switch of the image forming apparatus 10 is changed from an off state to an on state, or when the image forming apparatus 10 is changed from a sleep state or a power saving state to an operating state.

As illustrated in FIG. 11, in ACT 120, the heater control unit 306 (FIG. 10) determines whether a pre-determined time length has elapsed since the starting of the process. This time length is set by the manufacturer, and is longer than a time length at which the zero-crossing detection signal is obtained by at least two times and is thus about 100 ms to 1000 ms when the frequency of the commercial power source is 50 Hz. After a time period of this time length has elapsed since the start of the process (YES in the process of ACT 120), the control program 3 proceeds to a process of ACT 126. Otherwise (NO in the process of ACT 120), the control program 3 proceeds to a process of ACT 122.

In ACT 122, the heater control unit 306 determines whether the zero-crossing detection signal (FIGS. 6 and 7) of the logical value H is received from the zero-crossing detection circuit 292. When the zero-crossing detection signal of the logical value H is received (YES in the process of ACT 122), the control program 3 proceeds to a process of ACT 124. Otherwise (NO in the process of ACT 122), the control program 3 remains at the process of ACT 122.

In ACT 124, the heater control unit 306 measures a cycle of the zero-crossing detection signal in changing from the logical value L to the logical value H by using the clock signal of the CPU. As described above, such a cycle is 10 ms when the frequency of the commercial power source is 50 Hz and is about 8.3 ms when the frequency is 60 Hz.

In ACT 126, the heater control unit 306 multiplies the cycle at which the zero-crossing detection signal changes from the logical value L to the logical value H measured in the process of ACT 124 by 10 times and 20 times to determine a control cycle corresponding to the column values 1 to 10 in Table 1 and the column values 1 to 20 in Table 2, and proceeds to the process of ACT 100 (FIG. 10).

Hereinafter, the process of ACT 16 illustrated in FIG. 10 is described in more detail with reference to FIG. 12. As illustrated in FIG. 12, in ACT 160, the temperature receiving unit 304 receives the value of the temperature of the fixing member 51 detected by the temperature sensor 72 (FIGS. 3 and 5), and outputs the value to the heater control unit 306.

In ACT 162, the heater control unit 306 obtains a difference between the value of the temperature of the fixing member 51 input from the temperature receiving unit 304 and the setting value of the temperature of the fixing member 51 input from the setting analysis unit 302, that is, the setting value of the heating temperature of the heater 60. Further, the heater control unit 306 determines whether an absolute value of the obtained difference is smaller than a first threshold value (for example, 5° C.) that is pre-set by the manufacturer and is used to determine whether the difference between the value of the heating temperature of the heater 60 and the setting value thereof is within the acceptable error range.

When the absolute value of the difference is smaller than the threshold value (YES in the process of ACT 162), the control program 3 ends the process of ACT 16. Otherwise (NO in the process of ACT 162), the control program 3 proceeds to a process of ACT 164.

In ACT 164, the heater control unit 306 determines whether the absolute value of the difference between the value of the heating temperature of the heater 60 and the setting value thereof is smaller than a second threshold value that is pre-set by the manufacturer and used to select between Tables 1 and 2. When the absolute value of the difference is smaller than the second threshold value (YES in the process of ACT 164), the control program 3 proceeds to a process of ACT 168, and otherwise (NO in the process of ACT 164) proceeds to a process of ACT 166.

In ACT 166, the heater control unit 306 controls to adjust the heating temperature of the heater 60. That is, the heater control unit 306 outputs a control signal for causing the duty ratio control circuit 296 (FIG. 6) to select Table 1 stored in the pattern storage circuit 294.

In ACT 168, the heater control unit 306 controls to adjust the heating temperature of the heater 60. That is, the heater control unit 306 outputs a control signal for causing the duty ratio control circuit 296 to select Table 2 stored in the pattern storage circuit 294.

In ACT 170, the heater control unit 306 determines whether the detected value of the heating temperature of the heater 60 is higher than the setting value thereof. When the value of the heating temperature of the heater 60 is higher than the setting value thereof (YES in process of ACT 170), the control program 3 proceeds to a process of ACT 174. Otherwise (NO in the process of ACT 170), the control program 3 proceeds to the process of ACT 172.

In ACT 172, the heater control unit 306 performs a process for raising the heating temperature of the heater 60. In other words, the heater control unit 306 outputs a control signal to the duty ratio control circuit 296, and selects a row including a permutation of logical values, in which a duty ratio is larger than the current duty ratio used to control the heating temperature, from the Table 1 or Table 2 as selected to control the heating temperature of the heater 60 in the process of ACT 166 or ACT 168. The duty ratio control circuit 296 starts controlling the power supply to the heater 60 according to information included in the row selected as described above and returns to the process of ACT 162.

In ACT 174, the heater control unit 306 performs a process for lowering the heating temperature of the heater 60. In other words, the heater control unit 306 outputs a control signal to the duty ratio control circuit 296, and selects a row including a permutation of logical values, in which a duty ratio is smaller than the current duty ratio used to control the heating temperature, from Table 1 or Table 2 selected to control the heating temperature of the heater 60 in the process of ACT 166 or ACT 168. The duty ratio control circuit 296 starts controlling the power supply to the heater 60 according to information included in the row selected as described above and returns to the process of ACT 162.

In the image forming apparatus 10, the control cycle of the power supply to the heater 60 is automatically synchronized with a frequency and cycle of a commercial power source in an installed country or region even if the image forming apparatus 10 is installed in any countries or regions where a frequency of the commercial power source may vary. In the image forming apparatus 10, according to the control of the temperature of the fixing member 51, that is, the control for adjusting the heating temperature of the heater 60, the control of the power supply to the heater 60 is accurately performed even when the image forming apparatus 10 is used different countries or regions.

It is assumed, as an example, that the frequency of power supply to the heater 60 is fixed to 50 Hz and the cycle thereof is fixed to 200 ms corresponding to the above-mentioned Tables 1 and 2, and the image forming apparatus 10 is installed in a country or region where the frequency of the commercial power source is set to 60 Hz. In this case, the control cycle is about 166.7 ms when the frequency of the commercial power source is 60 Hz.

Thus, in this case, a deviation of approximately 33.3 ms (≈200−166.7), which is about two cycles of 60 Hz commercial power source, occurs for every single control cycle. Since the duty ratio control is not performed during this period, the control of the power supply to the heater 60 is not accurate. Also, in this case, since a timing when a voltage of the commercial power source becomes 0 V and a timing when the power supply to the heater 60 from the commercial power source is turned on or off are deviated from each other, higher harmonics occurring with the commercial power source are increased. On the other hand, according to the control of the power supply to the heater 60 described above as an embodiment, such a control cycle deviation does not occur regardless of the frequency of the commercial power source. Therefore, it is still possible to accurately control the power supply to the heater 60 and to prevent harmonic components occurring in the commercial power source.

Second Embodiment

Figure 13:
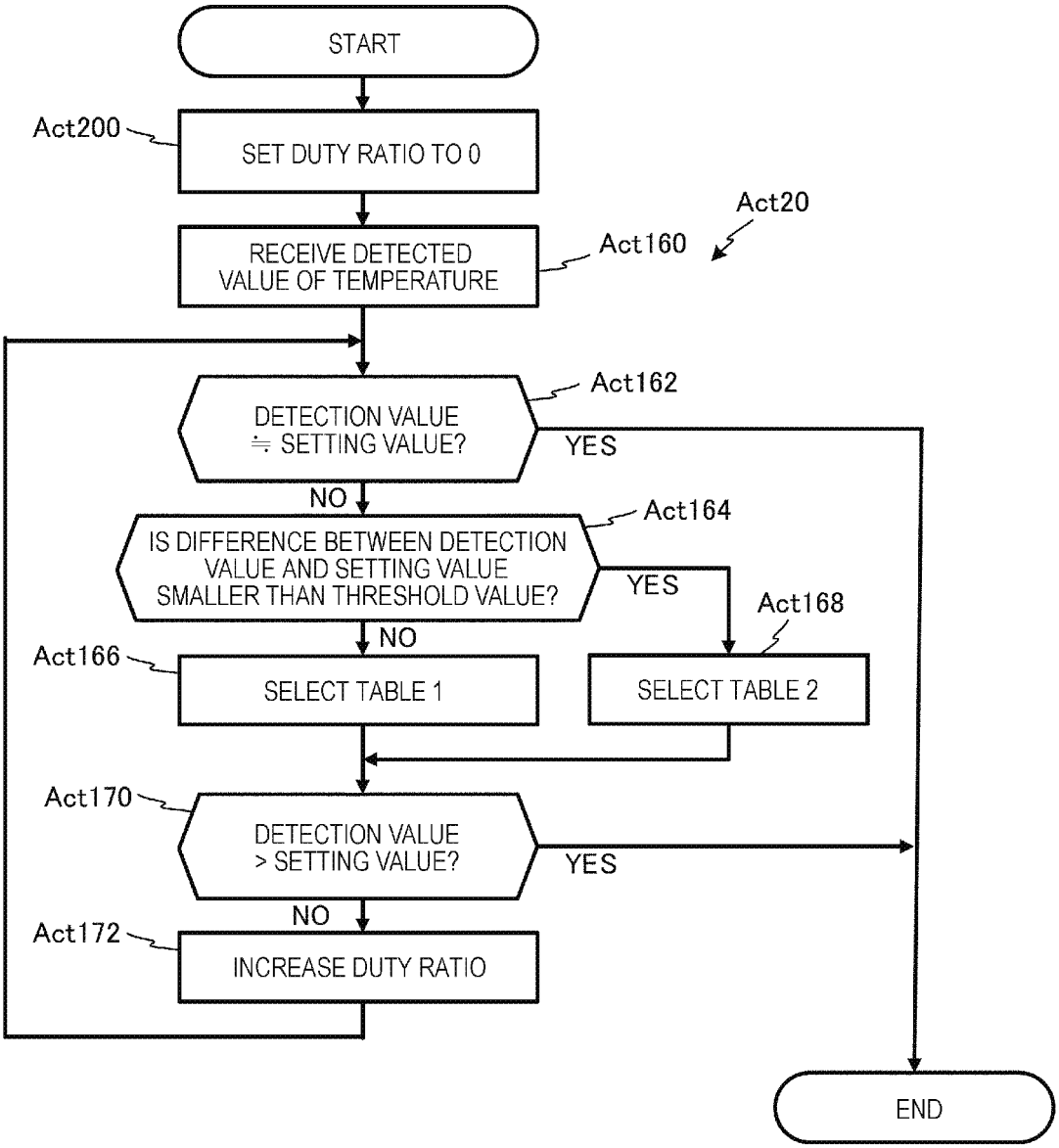
FIG. 13 is a flowchart aspects of a second temperature control process of a control program.

Hereinafter, a second embodiment is described. The first temperature control process (ACT 16) by the control program 3 illustrated in FIGS. 10 and 12 is replaced with a second temperature control process (ACT 20) described below. FIG. 13 is a flowchart illustrating the second temperature control process (ACT 20) of the control program 3 illustrated in FIGS. 10 and 12.

The second temperature control process is executed when the temperature of the fixing member 51, that is, the heating temperature of the heater 60 becomes equal to or higher than a temperature pre-set by the manufacturer and the image forming apparatus 10 causes the heating control device 29 to uniformly maintain a duty ratio of power supplied to the heater 60. Hereinafter, differences between the first temperature control process (ACT 16) and the second temperature control process (ACT 20) is described.

As illustrated in FIG. 13, in the second temperature control process (ACT 20), the process of ACT 200 is executed before ACT 160 of the first temperature control process (ACT 16) and the process of ACT 174 is omitted.

In ACT 200, in order to control the heating temperature of the heater 60, the heater control unit 306 outputs a control signal to the duty ratio control circuit 296 (FIG. 6) to select Table 1 stored in the pattern storage circuit 294, and further, selects a row in which the duty ratio is 0 from Table 1.

In ACT 170, the heater control unit 306 determines whether the detected value of the heating temperature of the heater 60 is higher than the setting value thereof. When the value of the heating temperature of the heater 60 is higher than the setting value thereof (YES in the process of ACT 170), the control program 3 ends the process of ACT 20 and proceeds to the process of ACT 106 (FIG. 10). Otherwise (NO in the process of ACT 170), the control program 3 proceeds to the process of ACT 172.

According to the second embodiment, a cycle of a commercial power source for supplying power to the heater 60 of the fixing device 50 and a cycle of duty ratio control can always be synchronized regardless of a value of a frequency of the commercial power source.

Figure 14:
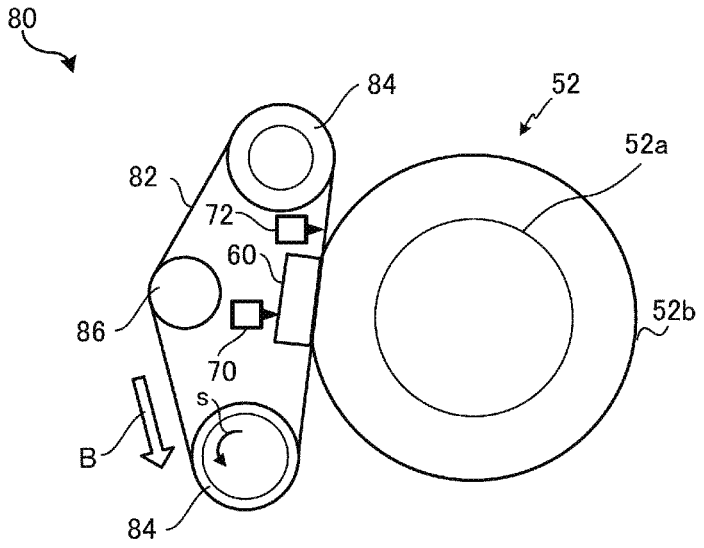
FIG. 14 depicts aspects of a second fixing device.

FIG. 14 is a diagram illustrating a configuration of a fixing device 80 that includes an endless belt 82 as a belt-shaped fixing member and is used instead of the fixing device 50 of the image forming apparatus 10 as illustrated in FIG. 1 or the like. The fixing device 80 includes, instead of the fixing member 51, the endless belt 82 in which an elastic layer is formed and within which a plurality of rollers are provided. The fixing device 80 includes a belt conveying rollers 84 that drive the endless belt 82, and a tension roller 86 that applies tension to the endless belt 82.

In some examples, it is necessary to perform on or off control of the commercial power source in synchronization with the frequency of the commercial power source, but it is not necessarily required to perform the on or off control at a zero-crossing point.

Furthermore, the number of image forming units 20Y, 20M, 20C, and 20K is not limited to four, and may be increased, or one or more may be omitted. Also, a frequency of an AC power source may be another value such as 400 Hz, instead of 50 Hz or 60 Hz.

Also, in Tables 1 and 2, the control cycle is settable to 5 cycles or 10 cycles of the AC power source, but the control cycle is not limited to these values. Also, Tables 1 and 2 are examples, and a resolution in the duty ratio for controlling power supply to the heater 60 may be higher or lower than 10% and 5%.

In addition, logic values H and L in a supply pattern for controlling a temperature of the fixing member 51 (or more particularly heater 60) may be a permutation other than those in Tables 1 and 2. Further, in addition to the supply patterns indicated in Tables 1 and 2, one or more supply patterns having different control cycles and resolutions of duty ratios may be prepared and used for duty ratio control. Further, in the image forming apparatus 10, instead of a value of the temperature of the fixing member 51 as detected by the temperature sensor 72, a value of the temperature of the heater 60 as detected by the temperature sensor 70 may be used for adjusting the temperature of the fixing member 51, that is, the heating temperature of the heater 60.

When there are one or more supply patterns in which a resolution of the duty ratio is different from those of Tables 1 and 2 and when a difference between the temperature of the fixing member 51, that is, the setting value of the heating temperature of the heater 60, and the detected heating temperature of the heater 60 is smaller than any of pre-set values, a supply pattern in which a resolution of a duty ratio is higher is selected. Further, when the difference is equal to or larger than any of the pre-set values, a supply pattern in which a resolution of a duty ratio is lower is selected.

In an embodiment of the present disclosure, an image forming method comprises: storing a plurality of control patterns for supply of AC power to a fixing device with different duty ratio resolutions; supplying AC power according to a selected one of the plurality of control patterns; and fixing a toner image to a medium using heat from a heater receiving the supply of AC power according to the selected one of the plurality of control patterns. The image forming method in some examples may further include: receiving AC power from an external source, detecting an actual cycle of the AC power as received from the external source, and synchronizing the supplying of AC power according to the selected one the plurality of control patterns to the actual cycle of the AC power.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions, and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. An image forming apparatus, comprising:

a heater configured to generate heat with AC power for fixing a toner image to a medium;

a power supply device configured to supply the AC power to the heater according to a pattern corresponding to one of at least two different combinations of a control cycle and a resolution in duty ratio;

a temperature sensor configured to detect a temperature of the heater and supply a temperature signal to the power supply device corresponding to the temperature of the heater, wherein the control cycle corresponds to an integer multiple of a nominal AC power cycle, the duty ratio reflects a number of nominal AC power cycles in the control cycle during which the heater is in an on state, the power supply device sets the pattern by selecting among the at least two combinations according to the temperature signal, and the power supply device is configured to select the combination having the shortest control cycle when a difference between the detected temperature and a setpoint temperature for the heater is greater than a predetermined threshold value.

2. The image forming apparatus according to claim 1, further comprising:

a storage device connected to the power supply device, wherein the at least two different combinations are stored in the storage device.

3. The image forming apparatus according to claim 1, further comprising:

a cycle detector configured to detect an actual cycle of the AC power as supplied from an external power source at the nominal AC power cycle.

4. The image forming apparatus according to claim 3, wherein the AC power is one of 50 Hz or 60 Hz in nominal frequency.

5. The image forming apparatus according to claim 3, wherein the power supply device is configured to synchronize the control cycle to the actual cycle of the AC power.

6. The image forming apparatus according to claim 1, wherein the heater is adjacent to an inner surface of a fixing belt.

7. An image forming apparatus, comprising:

a heater configured to generate heat with AC power for fixing a toner image to a medium;

a power supply device configured to supply the AC power to the heater according to a pattern corresponding to one of at least two different combinations of a control cycle and a resolution in duty ratio; and a temperature sensor configured to detect a temperature of the heater and supply a temperature signal to the power supply device corresponding to the temperature of the heater, wherein the control cycle corresponds to an integer multiple of a nominal AC power cycle, the duty ratio reflects a number of nominal AC power cycles in the control cycle during which the heater is in an on state, the power supply device sets the pattern by selecting among the at least two combinations according to the temperature signal, and the power supply device is configured to select the combination having the longest control when a difference between the detected temperature and a setpoint temperature of the heater is less than a predetermined threshold value.

8. The image forming apparatus according to claim 7, wherein the heater is adjacent to an inner surface of a fixing belt.

9. The image forming apparatus according to claim 7, further comprising:

a storage device connected to the power supply device, wherein the at least two different combinations are stored in the storage device.

10. The image forming apparatus according to claim 7, further comprising:

a cycle detector configured to detect an actual cycle of the AC power as supplied from an external power source at the nominal AC power cycle.

11. The image forming apparatus according to claim 10, wherein the AC power is one of 50 Hz or 60 Hz in nominal frequency.

12. The image forming apparatus according to claim 10, wherein the power supply device is configured to synchronize the control cycle to the actual cycle of the AC power.

* * * * *